United States Patent [19]

Asahina et al.

[11] Patent Number: 4,547,445

[45] Date of Patent: Oct. 15, 1985

[54] PHOTOGRAPHIC MATERIAL

[75] Inventors: Miyoshi Asahina; Keishi Kitagawa; Testuro Fuchizawa, all of Fujinomiya, Japan

[73] Assignee: Fuji Photo Film Co., Ltd., Kanagawa, Japan

[21] Appl. No.: 693,205

[22] Filed: Jan. 22, 1985

Related U.S. Application Data

[63] Continuation of Ser. No. 484,924, Apr. 14, 1983, abandoned.

[30] Foreign Application Priority Data

Apr. 21, 1982 [JP] Japan ..... 57-66911

[51] Int. Cl.[4] ..... G03C 1/78

[52] U.S. Cl. ..... 430/22; 283/77; 283/112; 283/904; 430/269; 430/523; 430/538; 430/539; 430/496

[58] Field of Search ..... 430/523, 22, 538, 539, 430/269, 496; 283/77, 112, 904

[56] References Cited

U.S. PATENT DOCUMENTS

| | | | |
|---|---|---|---|
| 817,663 | 4/1906 | Pifer | 430/496 |
| 3,520,758 | 7/1970 | Wiest | 283/77 |
| 3,607,345 | 9/1971 | Thomas et al. | 430/538 |
| 3,671,248 | 6/1972 | Eldridge et al. | 430/538 |
| 4,209,584 | 6/1980 | Joseph | 430/538 |

*Primary Examiner*—Jack P. Brammer

*Attorney, Agent, or Firm*—Toren, McGeady, Stanger, Goldberg & Kiel

[57] ABSTRACT

A photographic material capable of receiving and retaining an aqueous ink or other similar materials on the back surface, which is able to serve as a post card, is disclosed. The photographic material comprises a water-proof support comprising a paper sheet coated with a polyolefin resin on both surfaces thereof, and a photographic emulsion layer provided onto one of the surfaces of the support, in which another surface of the support is provided with a gelatin layer containing an inorganic pigment and one or more of specific gelatin hardening agents.

5 Claims, No Drawings

PHOTOGRAPHIC MATERIAL

This is a continuation of application Ser. No. 484,924 filed Apr. 14, 1983, now abandoned.

This invention relates to a photographic material which comprises a water-proof support comprising a paper sheet coated with a polyolefin resin on both surfaces thereof, and a photographic emulsion layer provided onto one of the surfaces of the support.

The photographic material comprising a water-proof support is called a water-proof photographic material and was invented to keep the paper support from permeation of a developing solution or washing-water thereinto and to render the developing time prominently shorter as compared with that of a conventional baryta paper.

It is sometimes desired to write letters, draw a picture, or print a stamp on a back surface (a surface having no photographic emulsion layer) of a photographic material. For this reason, there has been a demand for a photographic material having printing, drawing and writing characteristics on its back surface.

Such a photographic material can be also employed as a post card if the photographic material is so made as to receive a stamp under adhesion on the back surface. Thus, a photographic material of this type is employable for various purposes.

As described above, however, the back surface of a photographic material is generally coated with a hydrophobic polyolefin layer (generally employed is a polyethylene layer), so that it is difficult to put letters or a picture by the use of a pencil, conté crayon or fountain pen on the surface as such. Further, a stamp printed on the surface is not rapidly dried because the polyolefin layer has no hygroscopic property. Furthermore, the stamp on the polyolefin layer is readily removed by rubbing or by similar action.

There are known a number of processes for giving the printing, drawing and writing characteristics to the polyolefin layer. Representative examples of the processes include: a process involving providing a large number of fine protrusions and depressions to the polyolefin layer; a process involving subjecting the polyolefin layer to corona discharge; and a process involving coating a surface active agent layer on the polyolefin layer. A polyolefin layer processed as above shows satisfactory writing characteristics under writing with an oily ink, but shows extremely poor writing characteristics under writing with an aqueous ink.

Heretofore, a number of arts have been proposed to overcome the above-described drawbacks. For instance, Japanese Patent Publication No. 44(1969)-14884 discloses an art involving provision of a layer comprising an acid, a polymerizable, organic film-producing substance resistant to an acid such as polyvinyl alcohol or carboxy-methylcellulose, and an aqueous silica sol. Japanese Patent Publication No. 50(1975)-36565 discloses an art involving providing a layer similar to that of the above. Japanese Utility Model Provisional Publication No. 52-(1977)-169426 discloses an art involving provision of a hygroscopic painting layer. Japanese Utility Model Application No. 55(1980)-136681 discloses an art involving provision of a layer containing a cationic organic substance and an inorganic pigment to the back surface of a photographic material.

The photographic materials according to these prior arts are fairly improved in the writing characteristics.

However, these photographic materials still have certain drawbacks; for instance, the provided layer is apt to separate from the photographic material in a developing process or is soluble in a developing solution. Otherwise, some layers should be placed after completion of the development. Accordingly, further improvements of the photographic materials are desired in view of practical uses.

It is accordingly, a principal object of the invention to provide a photographic material which is free from the above-mentioned drawbacks of the conventional arts. More specifically, the object of the invention includes providing a photographic material which has satisfactory writing characteristics free from the above-mentioned drawbacks.

The present invention resides in a photographic material comprising a water-proof support comprising a paper sheet coated with a polyolefin resin on both surfaces thereof, and a photographic emulsion layer provided onto one of the surfaces of the support, in which another surface of the support is provided with a gelatin layer containing an inorganic pigment and one or more gelatin hardening agents selected from the group consisting of those of active vinyl type, active halogen type, epoxy type, ethyleneimino type, methanesulfonic acid ester type, carbodiimide type, isoxazole type, active ester type, isocyanate type, dehydration-condensation peptide type, and inorganic type.

The present invention is further described hereinbelow in more detail.

The gelatin layer of the invention contains gelatin and the inorganic pigment preferably in the amount of 85–50 parts by weight and 15–50 parts by weight, respectively. The inorganic pigment is preferably capable of absorbing an oil in a ratio of not less than 100 cc./100 g. The gelatin layer of the invention contains the above-specified hardening agent preferably in the amount of 0.2–3 parts by weight of the gelatin layer.

The writing characteristics are rendered relatively poor if the gelatin content of the gelatin layer exceeds 85 % by weight or is less than 50 % by weight. Accordingly, the ratio between gelatin and the inorganic pigment preferably ranges from 85/15 to 50/50, and more preferably ranges from 80/20 to 60/40, by weight.

The gelatin layer of the invention hardly separates in a developing process and hardly is soluble in a developing solution. Further, the gelatin layer has appropriate whiteness and satisfactory writing characteristics for every kind of writing means even after subjected to a developing process. Accordingly, the gelatin layer can be provided onto a photographic material prior to subjecting the photographic material to a developing process. The gelatin layer can be coated on the photographic material in the stage for laminating a polyolefin resin over a paper sheet to prepare a photographic support. Alternatively, the gelatin layer can be coated on a prepared support in a separate stage. Otherwise, the gelatin layer can be provided in or after the stage for coating a photographic emulsion on a photographic support. Of course, the gelatin layer can be placed on a photographic material already having a developed image.

The photographic material of the invention comprising the gelatin layer on the back surface is not only useful for writing thereon a date or memory of photographing, but also employable as a post card.

A photographic support of the photographic material according to the invention has a basic structure consisting of a paper sheet, polyolefin resin layers coated on both surfaces of the sheet, and a matte layer provided onto a polyolefin layer on the back surface and shows satisfactory writing characteristics. The terminology "writing characteristics" means that a surface is able to receive an ink, pencil or other writing means and retain the applied dye or others firmly.

The paper sheet is prepared from materials which are generally employable for the preparation of a photographic support. Examples of such materials include natural pulp paper, synthetic pulp paper, paper prepared from a mixture of natural pulp and synthetic pulp, and various composite papers. The paper sheet generally has the thickness of 30–500 μm.

Into the paper sheet there can be optionally incorporated one or more internal additives generally employable in the conventional paper manufacturing art such as a paper strength increasing agent, a fixing agent, a preserving agent, a filler and an antistatic agent, and a surface sizing agent can be also applied onto the paper sheet.

Examples of the polyolefin resin employable for preparing the polyolefin layer include homopolymers of α-olefins such as polyethylene and polypropylene, copolymers of α-olefins such as ethylene and propylene, and mixtures of these polymers. Particularly preferred are high density polyethylene, low density polyethylene and a mixture thereof. There is no specific limitation on the molecular weight of the polyolefin, as far as the polyolefin can be coated by the extrusion coating procedure. However, a polyolefin with the molecular weight ranging from 20,000 to 200,000 is generally employed. There is no specific limitation on the thickness of the polyolefin layer, and the thickness can be optionally set according to the thickness of the polyolefin layer of a conventional photographic support. The thickness generally ranges from 10 to 100 μm, and preferably ranges from 15 to 50 μm.

It is known to incorporate one or more of a variety of additives such as a white pigment, a color pigment, a fluorescent whitening agent, and an antioxidizing agent into a polyolefin resin to be coated on the paper sheet. One or more of these additives can be also incorporated into the polyolefin layer of the photographic support according to the invention. Particularly, a polyolefin layer on which a photographic emulsion layer is to be coated is ought to contain a white pigment and a color pigment. The kinds, amounts and manners of addition of these additives are described in detail, in various publications such as U.S. Pat. Nos. 3,833,380, 4,169,188, 3,501,298, 3,499,257, and 3,499,762.

The gelatin layer provided onto the back surface of the photographic material of the invention is further described below.

As described before, the inorganic pigment preferably is capable of absorbing an oil in a ratio of not less than 100 cc./100 g. If an inorganic pigment having absorbing capacity of less than 100 cc./100 g. is employed to incorporate into the gelatin layer, the ink-absorbing rate of the gelatin layer is extremely retarded so that the letters written on the layer are readily removed by rubbing with fingers or are readily transferred onto another papers placed in contact therewith. The writing characteristics similar to those of an ordinary post card or letter paper can be provided to the gelatin layer only when an inorganic pigment having the oil absorbing capacity of not less than 100 cc./100 g. is employed. Examples of such inorganic pigments include silica(crystalline or amorphous), hydrophilic silica, and calcined clay. The inorganic pigment can be employed singly or in combination.

The particle diameter of the inorganic pigment preferably ranges from 0.1 to 20 μm, and more preferably ranges from 0.2 to 5 μm. If the diameter is too large, the gelatin layer shows unsatisfactorily enlarged protrusions and depressions, resulting in deterioration of the writing characteristics. The writing characteristics are also deteriorated if an inorganic pigment having too small diameter is employed.

There is no specific limitation on gelatin to be employed as a binder for the preparation of the gelatin layer. Examples of gelatin include lime-treated gelatin, acid-treated gelatin, enzyme-treated gelatin, and gelatin derivatives or denatured gelatins treated or denatured with a reagent containing at least one group reactive with the amino group, imino group, hydroxyl group or carboxyl group contained in a gelatin molecule as the functional group, for instance, phthalated gelatin, citrated gelatin and trimellitated gelatin prepared by reactions with phthalic anhydride, succinic anhydride, and trimellitic anhydride, respectively.

In the photographic material of the invention, a gelatin hardening agent is incorporated into the gelatin layer. The incorporation of the hardening agent into the gelatin layer not only prevents dissolution of gelatin in a developing solution, but also improves the blotting tendency of an applied ink.

Examples of the gelatin hardening agent employable in the invention include the following compounds:

Active vinyl type hardening agents such as divinylsulfone N,N'-ethylenebis(vinylsulfonylacetamide), 1,3-bis(vinylsulfonyl)-2-propanol, methylenebismaleimide, 5-acetyl-1,3-diacryloyl-hexahydro-S-triazine, 1,3,5-triacryloyl-hexahydro-S-triazine, and 1,3,5-trivinylsulfonyl-hexahydro-S-triazine;

Active halogen type hardening agents such as 2,4-dichloro-6-hydroxy-S-triazine sodium salt, 2,4-dichloro-6-methoxy-S-triazine, 2,4-dichloro-6-(4-sulfoanilino)-S-triazine sodium salt, 2,4-dichloro-6-(2-sulfoethylamino)-S-triazine, and N,N-bis(2-chloroethylcarbamyl)piperazine;

Epoxy type hardening agents such as bis(2,3-epoxypropyl)methylpropylammonium p-toluenesulfonate, 1,4-bis(2',3'-epoxypropyloxy)butane, 1,3,5-triglycidylisocyanurate, and 1,3-diglycyl-4-(Y-acetoxy-β-oxypropyl)isocyanurate;

Ethyleneimino type hardening agents such as 2,4,6-triethylene-S-triazine, 1,6-hexamethylene-N,N'-bisethyleneurea, and bis-β-ethyleneiminoethyl thioether;

Methanesulfonic acid ester type hardening agents such as 1,2-di(methanesulfonoxy)ethane, 1,4-di(methanesulfonoxy)butane, and 1,5-di(methanesulfonoxy)pentane;

Carbodiimide type hardening agents such as dicyclohexylcarbodiimide, 1-cyclohexyl-3-(3-trimethylaminopropyl)carbodiimide p-toluenesulfonate, and 1-ethyl-3-(3-dimethylaminopropyl)carbodiimide hydrochloride;

Isoxazole type hardening agents such as 2,5-dimethylisoxazole perchlorate, 2-ethyl-5-phenylisoxazole-3'-sulfonate, and 5,5'-(p-phenylene)bisisoxazole;

Inorganic type hardening agents such as chrome alum and chromium acetate;

Dehydration-condensation peptide type hardening agents such as N-carboethoxy-2-isopropoxy-1,2-dihydroquinoline, and N-(1-morpholinocarboxy)-4-methylpyridinium chloride;

Active ester type hardening agents such as N,N'-adipoyldioxydisuccinimide and N,N'-terephthaloyldioxydisuccinimide; and Isocyanate type hardening agents such as toluene-2,4-diisocyanate and 1,6-hexamethylenediisocyanate.

Formalin and formalin-producing compounds are not appropriate as the gelatin hardening agents to be employed in the invention, because formalin is apt not only to give unfavorable influence to a photographic emulsion layer such as production of fog, but also to cause fading of an applied ink. Accordingly, aldehyde compounds and their derivatives such as mucochloric acid, mucobromic acid, mucophenoxychloric acid, mucophenoxybromic acid, formaldehyde, dimethylolurea, trimethylolmelamine, glyoxal, monomethylglyoxal, 2,3-dihydroxy-1,4-dioxane, 2,3-dihydroxy-5-methyl-1,4-dioxanesuccinaldehyde, 2,5-dimethoxytetrahydrofuran and glutaraldehyde are not appropriate as the gelatin hardening agents of the invention.

The gelatin hardening agent is preferably incorporated into the gelatin layer in the amount ranging from 0.20 to 3.0 % by weight of gelatin. If the amount of the hardening agent is less than 0.20 % by weight, the hardening degree is apt to be rather poor and gelatin is rendered soluble in a developing solution. If the amount of the hardening agent is more than 3.0 % by weight, the hardening sometimes proceeds too much so as to deteriorate the adhesion between the gelatin layer and the polyolefin layer resulting in possible separation of the gelatin layer. The optimum amount can be determined according to the employed coating method and the desired hardening degree.

As a solvent of a coating solution employable for preparing the gelatin layer of the photographic material of the invention, water and a mixture of water and an alcohol can be mentioned. Examples of the alcohol include a variety of alcohols such as methanol, ethanol, propyl alcohol, isopropyl alcohol, and butanol. If a mixture of water and an alcohol is employed, the ratio therebetween can be determined according to the desired drying rate and the employed coating method.

If desired, the coating solution (gelatin solution) can be made alkaline by addition of sodium hydroxide or the like, or made acidic by addition of citric acid or the like depending upon nature of the gelatin hardening agent employed. The coating solution can contain a defoaming agent for removing the possibly produced foams, and can contain a surface active agent to show satisfactory levelling property, as well as to prevent production of a coating streak. If desired, an antistatic agent is introduced into the coating solution.

The gelatin layer of the invention can be coated in a conventional manner. Examples of the coating methods include the dip coating method, air knife coating method, curtain coating method, roller coating method, doctor coating method, wire-bar coating method, slide coating method, gravure coating method, and extrusion coating method employing a hopper described in U.S. Pat. No. 2,681,294. If desired, the gelatin layer can be divided into two or more layers and coated at the same time in the methods described in U.S. Pat. Nos. 2,761,791, 3,508,947, 2,941,898, and 3,526,528, and "Coating Technology (in Japanese)" written by Yuji Harazaki (Asakura Shoten Tokyo, 1973), page 253. An appropriate coating method can be employed according to the desired coating amount and coating rate.

The gelatin layer can be coated in the amount preferably ranging from 0.5 to 20 g./m$^2$ (amount upon dried). If the gelatin layer is coated in an amount of less than 0.5 g./m$^2$, the layer shows poor absorption for an ink, resulting in increase of ink blotting. If the gelatin layer is coated in an amount of more than 20 g./m$^2$, various problems are likely brought about, for instance, high production cost, high curling tendency, and deterioration of writing characteristics. Most preferred range is from 1.8 to 15 g./m$^2$.

The back surface of a polyolefin layer of the photographic support, namely, a surface expected to receive no photographic emulsion layer, is preferably subjected to surface activation treatment in a conventional manner prior to the provision of the gelatin layer. Examples of the activation treatment include etching treatment using an acid, flame treatment using a gas burner, corona discharge treatment, and glow discharge treatment. In view of cost and simplicity for carrying out the activation treatment, most preferably employed is the corona discharge treatment described in U.S. Pat. Nos. 2,715,075, 2,846,727, 3,549,406, and 3,590,107.

There is no specific limitation on the photographic emulsion provided onto the support. For instance, a color photographic emulsion, a black-and-white photographic emulsion, and a photographic emulsion for the diffusion transfer system can be placed on the support.

The photographic emulsion can be placed on the photographic support in a conventional manner to prepare the photographic material of the invention. A subbing layer to provide increased adhesion between the support and photographic emulsion is preferably placed therebetween.

The so-prepared photographic material can be developed and fixed in a conventional manner.

The conventional manners concerning the photographic material and the developing and fixing process are described in, for instance, PHOTOGRAPHIC CHEMISTRY (in Japanese) by Shin-ichi Kikuchi (Kyoritsu Syuppan Tokyo, 1973) and THE THEORY OF THE PHOTOGRAPHIC PROCESS, 3rd ed., by C. E. K. Mees.

The present invention is now illustrated by the following examples, but these examples are given by no means to restrict the invention.

In the examples, the writing characteristics were evaluated as follows: The smoothness in writing was classified into three ranks, namely, A, B, and C. A means that a fountain pen moves relatively smoothly; B means that the pen moves simply without difficulty; and C means that the pen moves with difficulty. The photographic material given A or B is satisfactory in the practical use.

The photographic material was further evaluated on the ink blotting and ink absorption. In detail, a printing block on which certain letters and pattern were engraved was prepared. The printing block was pressed onto an ink pad in such conditions that the ink was transferred and retained in the same amount for every trial.

The printing block was subsequently pressed onto a test sample (photographic material) to provide reproduction of the letters and pattern of the block under the same conditions for every sample. The results were classified into three ranks, namely, A, B, and C. A means that the ink blotting was at a low level; B means that the blotting was at a medium level; and C means that conspicuous ink blotting was observed. The photographic material given A or B is satisfactory in the practical use.

The ink absorption was also observed in the above-described testing procedure, and classified into three ranks, A, B, and C. A means that the applied ink was absorbed by the gelatin layer within 30 seconds; B means that the ink was absorbed by the gelatin layer within 5 minutes but more than 30 seconds; and C means that the ink absorption by the gelatin layer required more than 5 minutes. The photographic material given A or B is satisfactory in the practical use.

The test samples for photographic material employed in the following examples were prepared as follows:

A polyethylene-coated support was subjected to corona discharge treatment on the back surface. The so-treated support was then coated with the gelatin solution set forth in the following Examples under (1) through (11) in the amount of 100 g./m$^2$ through the slide coating method. The support was subsequently dried and, in turn, coated with a photographic emulsion on the front surface. Thus, the Photographic materials embodying the present invention, that is, Photographic material (1) and Photographic materials (6) through (11), and the photographic materials prepared for comparison, that is, Photographic materials (2) through (5) were obtained.

EXAMPLE 1

| | |
|---|---|
| Gelatin Solution (1) | |
| Gelatin (alkali treated gelatin) | 75 g. |
| Silica (particle diameter: 0.2–10 μm, average diameter: 2.5 μm, oil absorbing capacity: 260 cc./100 g.) | 25 g. |
| Hardening Agent (2,4-dichloro-6-hydroxy-S—triazine sodium salt) | 0.38 g. |
| Water | 1 liter |
| Gelatin Solution (2) | |
| Gelatin (same as that of Gelatin Solution (1)) | 75 g. |
| Titanium dioxide (oil absorbing capacity: 40 cc./100 g.) | 25 g. |
| Hardening Agent (same as that of Gelatin Solution(1)) | 0.38 g. |
| Water | 1 liter |
| Gelatin Solution (3) | |
| Gelatin (same as that of Gelatin Solution (1)) | 75 g. |
| Silica (same as that of Gelatin Solution (1)) | 25 g. |
| Water | 1 liter |
| Non-gelatin Solution (4) | |
| Polyvinyl alcohol | 75 g. |
| Silica (same as that of Gelatin Solution (1)) | 25 g. |
| Water | 1 liter |
| Gelatin Solution (5) | |
| Gelatin (same as that of Gelatin Solution (1)) | 75 g. |
| Silica (same as that of Gelatin Solution (1)) | 25 g. |
| 40% formalin | 1 g. |
| water | 1 liter |

The results of the evaluations on the writing characteristics such as smoothness in writing, ink blotting, and behavior in a developing process are set forth in Table 1. Other properties noted are also set forth in Table 1.

TABLE 1

| Photographic Material | Writing Characteristics: Smoothness in writing | Ink blotting | Ink absorption | Behavior in Development | Remark |
|---|---|---|---|---|---|
| (1) | A | A | A | Satisfactory | — |
| (2) | A | B | C | " | — |
| (3) | A | C | B | Gelatin dissolved | — |
| (4) | B | B | B | Gelatin dissolved | — |
| (5) | A | A | A | Satisfactory | Ink fading |

The results set forth in Table 1 clearly indicate that the photographic material provided with the gelatin layer of the invention on its back surface was satisfactorily in the writing characteristics, as well as behavior in a developing process. No other unfavorable features were noted.

In contrast, other photographic materials prepared for comparison showed at least one unfavorable feature. In more detail, Photographic material (2) employing titanium dioxide showing low oil absorption was unsatisfactory in the ink absorption. Photographic material (3) containing no hardening agent was unsatisfactory in the ink blotting and behavior in a developing process. Photographic material (4) in which the gelatin layer was replaced with the polyvinyl alcohol layer was unsatisfactory in the behavior in a developing process. Photographic material (5) containing formalin was unsatisfactory because ink rapidly faded as time passed by, even though other properties were satisfactory.

EXAMPLE 2

The gelatin solutions (6) through (11) were prepared in the same formulation as the gelatin solution (1) set forth in Example 1 except that the hardening agent was replaced with the hardening agent set forth in Table 2.

The results of the evaluations on the writing characteristics and behavior in a developing process were nearly same as those observed in Photographic material (1) of Example 1.

TABLE 2

| Gelatin Solution | Hardening Agent |
|---|---|
| (6) | 1,3,5-trivinylsulfonyl-hexahydro-S—triazine |
| (7) | 1,3,5-triglycidylisocyanurate |
| (8) | 1,5-di(methanesulfonoxy)pentane |
| (9) | 1-ethyl-3-(3-dimethylaminopropyl)carbodiimide hydrochloride |
| (10) | 5,5'-(p-phenylene)bisisoxazole |
| (11) | chrome alum |

We claim:

1. In a process for placing letters, pictures or stamps fixedly on a back surface of a photographic material, the improvement which comprises said photographic material comprising a water-proof support comprising a paper sheet coated with a polyolefin resin on both surfaces thereof, and a photographic emulsion layer provided onto one of the surfaces of the support, in which another surface of the support is provided with a gelatin layer containing an inorganic pigment and one or more gelatin hardening agents selected from the group consisting of those of the active vinyl type, active halogen type, epoxy type, ethyleneimino type, methanesulfonic acid ester type, carbodiimide type, isoxazole type, active ester type, isocyanate type, dehydration-condensation peptide type and inorganic type, said gelatin layer being present on the surface of the support in an amount of from 0.5 to 20 g/m$^2$, and containing gelatin and an inorganic pigment in the amount from 85–50 parts by weight and 15–50 parts by weight, respectively, and further containing a gelatin hardening agent in an amount from 0.2 to 3 parts by weight of the gelatin layer, said inorganic pigment having an absorbing capacity of not less than 100 cc/100 g, and placing the letters, pictures or stamps on the surface of said gelatin layer.

2. The process of claim 1 wherein the inorganic pigment is selected from the group consisting of silica, hydrophilic silica and calcined clay.

3. The process of claim 1 wherein the inorganic pigment has a mean diameter of 0.1 to 10 m.

4. The process of claim 1 wherein the ratio of the gelatin and the inorganic pigment is 80–60 parts by weight to 20–40 parts by weight.

5. The process of claim 1 wherein the gelatin layer is provided onto the surface of the support in an amount of 1.8 to 15 g/m$^2$.

* * * * *